US011280116B2

(12) United States Patent
Scarfone

(10) Patent No.: US 11,280,116 B2
(45) Date of Patent: Mar. 22, 2022

(54) CLOSURE LATCH ASSEMBLY WITH CHILD LOCK HAVING ASYMMETRICAL TOGGLE SPRING ARRANGEMENT

(71) Applicant: MAGNA CLOSURES INC., Newmarket (CA)

(72) Inventor: Vincenzo Scarfone, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 414 days.

(21) Appl. No.: 16/409,992

(22) Filed: May 13, 2019

(65) Prior Publication Data

US 2019/0352941 A1 Nov. 21, 2019

Related U.S. Application Data

(60) Provisional application No. 62/671,577, filed on May 15, 2018.

(51) Int. Cl.

| | |
|---|---|
| ***E05B 77/26*** | (2014.01) |
| ***E05B 15/04*** | (2006.01) |
| ***E05B 85/00*** | (2014.01) |
| ***E05B 15/00*** | (2006.01) |
| ***E05B 65/00*** | (2006.01) |

(52) U.S. Cl.

CPC ..... *E05B 77/265* (2013.01); *E05B 15/008* (2013.01); *E05B 15/04* (2013.01); *E05B 85/00* (2013.01); *E05B 65/0014* (2013.01); *E05B 77/26* (2013.01); *E05B 2015/0448* (2013.01); *E05B 2015/0458* (2013.01); *E05B 2015/0468* (2013.01)

(58) Field of Classification Search

CPC ..... E05B 77/265; E05B 77/26; E05B 85/02; E05B 2015/0434; E05B 2015/0448; E05B 2015/0458; E05B 2015/0468; E05B 2015/0431; E05B 2015/0493; E05B 65/0014; Y10T 292/1082; Y10T 292/1047; Y10S 292/23

USPC ..... 292/216, 219, 220

See application file for complete search history.

(56) References Cited

U.S. PATENT DOCUMENTS

| | | | | |
|---|---|---|---|---|
| 9,534,425 | B2 * | 1/2017 | Hunt | E05B 77/06 |
| 10,280,655 | B2 * | 5/2019 | Dragon | E05B 77/265 |
| 2007/0220934 | A1 * | 9/2007 | Chevalier | E05B 77/28 70/237 |

(Continued)

FOREIGN PATENT DOCUMENTS

| | | | |
|---|---|---|---|
| EP | 1869274 | B1 | 1/2011 |
| WO | WO0163077 | A1 | 8/2001 |
| WO | WO2009030046 | A1 | 3/2009 |

*Primary Examiner* — Kristina R Fulton
*Assistant Examiner* — Matthew Thomas Evanko
(74) *Attorney, Agent, or Firm* — Dickinson Wright PLLC

(57) ABSTRACT

A latch assembly is provided with a child lock mechanism having a spring system including a first spring member and a separate second spring member that requires a first force to move the child lock mechanism from an off position to an on position and a second force to move the child lock mechanism from the on position to the off position, wherein the required second force is greater than the required first force, thereby indicating to a user by tactile feedback the relative position (on/off) the child lock mechanism is in, thereby assuring intended movement of the child lock mechanism from one of the on/off positions to the other.

20 Claims, 11 Drawing Sheets

(56) References Cited

U.S. PATENT DOCUMENTS

| | | | | |
|---|---|---|---|---|
| 2009/0322105 | A1* | 12/2009 | Lee | E05B 77/06 292/237 |
| 2010/0127511 | A1* | 5/2010 | Vasquez | E05B 81/34 292/201 |
| 2011/0006551 | A1* | 1/2011 | Konchan | E05B 85/26 292/216 |
| 2012/0068480 | A1* | 3/2012 | Bendel | E05B 85/26 292/220 |
| 2012/0091740 | A1* | 4/2012 | Chevalier | E05B 81/20 292/226 |
| 2016/0053517 | A1 | 2/2016 | Tomaszewski | |
| 2018/0209180 | A1* | 7/2018 | Ishiguro | E05B 77/06 |
| 2019/0271178 | A1* | 9/2019 | Basavarajappa | E05B 83/36 |

* cited by examiner

CLOSURE LATCH ASSEMBLY WITH CHILD LOCK HAVING ASYMMETRICAL TOGGLE SPRING ARRANGEMENT

CROSS-REFERENCE TO RELATED APPLICATION

This application claims the benefit of U.S. Provisional Application Ser. No. 62/671,577, filed May 15, 2018, which is incorporated herein by reference in its entirety.

FIELD

The present disclosure relates generally to closure latch assemblies for motor vehicle closure systems, and more particularly, to closure latch assemblies having a child lock mechanism and to vehicle closure systems therewith.

BACKGROUND

Motor vehicles are known to have closure latch assemblies with child lock mechanisms, particularly on rear passenger vehicle doors, that allow a user to deactivate an inside door handle of the passenger door. With the inside door handle deactivated, the door can only be opened via an outside door handle or other electronically activated device, such as a key fob, thereby providing assurance that a passenger, such as a child, is unable to open the door from inside the vehicle. Typically, child lock mechanisms have a knob that can be actuated to alter the state of the child lock mechanism between "off" and "on" positions. When in the off position, the child lock mechanism is deactivated, thereby allowing the inside door handle to be used to open the door. When in the on position, the child lock mechanism is activated, thereby preventing the inside door handle from being used to open the door.

Generally, the knob used to affect the state of the child lock mechanism is rotated to overcome a spring bias to move the child lock mechanism from the off position to the on position, and vice versa. The spring force is typically uniform regardless of the direction of knob actuation, and thus, the user experiences the same feel and resistance while moving the knob from the off position to the on position, and vice versa. Accordingly, unless the user is able to see an indicator, marking or otherwise knows and remembers the proper direction of actuation, the user generally will not know for certain if the actuation is toward the on position or off position, other than by testing the inside door handle. Further yet, a balance in manufacture must be made to ensure the spring force is great enough to allow relatively easy actuation, particularly to the on position, while at the same time, ensuring the child lock mechanism remains in the on position, when desired.

Desired, among other things, is a child lock mechanism that can provide tactile feedback to the user to indicate the state (mode) of operation the child lock mechanism is being moved. Further desired is a child lock mechanism that is easy to manufacture, easy to assemble, and assured of remaining in the child lock on position, as intended, while also being relatively easy to actuate from the off position to the on position over the useful life of the child lock mechanism.

Accordingly, although commercially-available closure latch assemblies are satisfactory to meet operational and regulatory requirements, recognized needs exist to advance the development of closure latch assemblies and child lock mechanisms thereof having reduced complexity and packaging while providing reliable, easy to use features.

SUMMARY

This section provides a general summary of the present disclosure and is not a comprehensive disclosure of its full scope or all of its features, aspects and objectives.

In accordance with an aspect of the disclosure, a latch assembly is provided that addresses drawbacks associated with child lock mechanisms of known latch assemblies.

In accordance with a further aspect of the disclosure, a latch assembly is provided having a child lock mechanism that requires a first force to move a child lock knob and child lock lever to an on position and a second force to return the child lock knob and child lock lever to an off position, wherein the second force required is greater than the first force.

In accordance with a further aspect of the disclosure, a latch assembly is provided with a child lock mechanism having a spring system including a first spring member and a separate second spring member spaced in overlying relation with one another, such that the spring system requires a first force to move the child lock mechanism from an off position to an on position and a second force to move the child lock mechanism from the on position to the off position, wherein the required second force is greater than the required first force, thereby indicating to a user by tactile feedback the relative position (on/off) the child lock mechanism is in, thereby assuring intended movement of the child lock mechanism from one of the on/off positions to the other.

In accordance with a further aspect of the disclosure, the aforementioned first spring member and separate second spring member of the spring system can be formed as a single, monolithic piece of material with one another, thereby making manufacture and assembly reliable and economical.

In a particular embodiment, a latch assembly for a passenger door of a motor vehicle is provided, wherein the latch assembly includes a housing with a detent fixed therein. A ratchet is operably mounted to the housing for pivoting movement between a closed position and an open position. A pawl is operably mounted to the housing for pivoting movement between a locking position, whereat the ratchet is maintained in the closed position, and an unlocking position, whereat the ratchet is allowed to move to the open position. An inside release lever is operably mounted to the housing for pivoting movement between an actuated position and a released position. An auxiliary release lever is configured in operable communication with the pawl and in selective communication with the inside release lever for pivoting movement between a first position and a second position in response to actuation of the inside release lever to move the pawl from the locking position to the unlocking position, while in communication with the inside release lever. A release link is supported by the auxiliary release lever for selective pivotal movement between a coupled position with the inside release lever, whereat the inside release lever is in selective communication with the auxiliary release lever to allow movement of the pawl from the locking position to the unlocking position upon pivoting the inside release lever to the actuated position, and a decoupled position from the inside release lever, whereat the inside release lever is not in selective communication with the pawl, thereby preventing movement of the pawl from the locking position to the unlocking position upon pivoting the inside release lever to the actuated position. The latch assembly further has a child lock mechanism including a child lock knob and a child lock lever coupled for fixed rotation with one another about a child lock axis. The child lock knob is configured for selective rotation between an on position, whereat the release link is in the decoupled position, and an off position, whereat the release link is in the coupled position. The child lock lever has a body fixed to the child lock knob with a drive arm extending from the body. The drive arm is operable to pivot the release link between the coupled and decoupled positions in response to selective rotation of the child lock knob. The child lock mechanism has a spring system that extends from the body. The spring system includes an inside spring member spaced outwardly from the body by a first gap and an outside spring member spaced outwardly from the inside spring member by a second gap, such that the inside spring member is between the outside spring member and the body. While the child lock knob is in the off position, a first spring force of the inside spring member against the detent is encountered while the child lock knob is moved toward the on position, and wherein while the child lock knob is in the on position, a second spring force of the inside spring member against the detent is encountered while the child lock knob is moved toward the off position, with the second spring force being greater than the first spring force.

In accordance with a further aspect of an embodiment, at least one release member can be provided to operably communicate the auxiliary release lever with the pawl to facilitate moving the pawl between the locking and unlocking positions.

In accordance with a further aspect of an embodiment, the at least one release member can include one or more levers.

In accordance with a further aspect of an embodiment, the at least one release member can include a pawl lever and a release lever configured in operable communication with one another.

In accordance with a further aspect of an embodiment, the inside spring member has an elongate arm extending between a first end fixed to the body of the child lock lever and an opposite second end cantilevered in spaced relation from the body of the child lock lever.

In accordance with a further aspect of an embodiment, the detent is located adjacent the second end of the inside spring member while the child lock knob is in the off position, and the detent is located adjacent the first end of the inside spring member while the child lock knob is in the on position.

In accordance with a further aspect of an embodiment, the arm of the inside spring member is arcuate.

In accordance with a further aspect of an embodiment, the arm of the inside spring member has a convex surface facing the outside spring member.

In accordance with a further aspect of an embodiment, the outside spring member has a substantially straight portion overlying the inside spring member.

In accordance with a further aspect of an embodiment, the outside spring member has an elongate bridge extending between opposite end regions fixed to the body, wherein the inside spring member is encircled by the body and the outside spring member.

In accordance with a further aspect of an embodiment, the outside spring member has a substantially straight portion extending between the opposite end regions, with the substantially straight portion being spaced outwardly in overlying relation with the inside spring member.

In accordance with a further aspect of an embodiment, the outside spring member has opposite end regions extending from the substantially straight portion inwardly to the body.

In accordance with a further aspect of an embodiment, the opposite end regions of the second spring member converge from the substantially straight portion inwardly generally toward the child lock axis to the body of the child lock lever.

In accordance with a further aspect of the disclosure, a method of indicating, via tactile feedback, to a user that a child lock mechanism of a latch assembly for a passenger door of a motor vehicle is being moved toward an on position, whereat the passenger door is unable to be opened by via actuation of an inside door handle, and an off position, whereat the passenger door is able to be opened by via actuation of an inside door handle, is provided. The method includes a step of providing the child lock mechanism with a child lock lever fixed for conjoint movement with a child lock knob that is accessible on the passenger door to a user for selective movement of the child lock knob to place the child lock mechanism in one of the on position and off position. The method further includes a step of providing child lock lever having a body configured in fixed relation with the child lock knob and having a drive arm extending from the body for pivoting a release link between a coupled position, whereat the child lock mechanism is in the off position, and a decoupled position, whereat the child lock mechanism is in the on position, in response to selective movement of the child lock knob. The method further includes a step of providing the child lock lever having a spring system extending from the body for engagement with a detent of the latch assembly and configuring the spring system to impart a first resistance to movement on the detent along the spring system while the child lock knob is being moved from the off position to the on position and to impart a second resistance to movement on the detent along the spring system while the child lock knob is being moved from the on position to the off position, with the second resistance to movement being perceivably (via tactile feel of the user, such as via noticeable torque difference) different from the first resistance to movement.

In accordance with a further aspect of the disclosure, the method can include providing the spring system having a cantilevered inside spring member configured to engage the detent and extending between a first end fixed to the body and a second end suspended in detached relation from the body, with the first resistance being provided as the detent moves from the second end toward the first end, and the second resistance being provided as the detent moves from the first end toward the second end, wherein the second resistance is greater than the first resistance.

In accordance with a further aspect of the disclosure, the method can include providing the spring system having an outside spring member overlying the inside spring member, with the inside spring member extending between the second spring member and the body, wherein the detent is positioned to slide in engagement with the inside spring member and the outside spring member, with a predetermined resistance being created between the detent and the inside and outside spring members.

In accordance with a further aspect of the disclosure, the method can include providing the outside spring member having an elongate bridge extending between opposite end regions fixed to the body, such that the elongate bridge deflects resiliently outwardly and returns resiliently inwardly as the detent slides between the inside spring member and the outside spring member.

In accordance with a further aspect of the disclosure, the method can include providing the opposite end regions of the outside spring member converging from the elongate bridge inwardly generally toward a child lock axis about which the child lock lever rotates.

In accordance with a further aspect, there is provided a latch assembly for a passenger door of a motor vehicle having a child lock mechanism for a latch assembly, the child lock mechanism being moveable toward an on position, whereat the passenger door is unable to be opened by via actuation of an inside door handle, and an off position, whereat the passenger door is able to be opened by via actuation of the inside door handle, the child lock mechanism having: a child lock lever fixed for conjoint movement with a child lock knob that is accessible on the passenger door to a user for selective movement of the child lock knob to place the child lock mechanism in one of the on position and off position, the child lock lever having a body configured to be fixed to the child lock knob and having a drive arm extending from the body for pivoting a release link between a coupled position, whereat the child lock mechanism is in the off position, and a decoupled position, whereat the child lock mechanism is in the on position, in response to selective movement of the child lock knob; and a spring system extending from the body for engagement with a detent of the latch assembly and configuring the spring system to impart a first resistance to movement on the detent while the child lock knob is being moved from the off position to the on position and to impart a second resistance to movement on the detent while the child lock knob is being moved from the on position to the off position, with the second resistance to movement being different from the first resistance to movement.

In accordance with a further aspect, there is provided a method of operating a child lock mechanism moveable between an on position, whereat the passenger door is unable to be opened by via actuation of an inside door handle, and an off position, whereat the passenger door is able to be opened by via actuation of the inside door handle, the method including: providing the child lock mechanism with a child lock lever fixed for conjoint movement with a child lock knob that is accessible on the passenger door to a user for selective movement of the child lock knob to place the child lock mechanism in one of the on position and off position; providing child lock lever having a body configured to be fixed to the child lock knob and having a drive arm extending from the body for moving a release link between a coupled position, whereat the child lock mechanism is in the off position, and a decoupled position, whereat the child lock mechanism is in the on position, in response to selective movement of the child lock knob; and providing the child lock lever having a spring system extending from the body for engagement with a detent of the latch assembly and configuring the spring system to impart a first resistance to movement on the detent while the child lock knob is in the off position and to impart a second resistance to movement on the detent while the child lock knob is in on position, with the second resistance being different than the first resistance.

In accordance with another aspect, there is provided a passenger door of a motor vehicle child having a latch assembly with a child lock mechanism, the child lock mechanism having a spring system extending from the body for engagement with a detent of the latch assembly and configuring the spring system to impart a first resistance to movement on the detent while the child lock knob is being moved from the off position to the on position and to impart a second resistance to movement on the detent while the child lock knob is being moved from the on position to the off position, with the second resistance to movement being different from the first resistance to movement.

Further areas of applicability will become apparent from the description provided herein. The description and specific examples in this summary are only intended to illustrate certain non-limiting embodiments which are not intended to limit the scope of the present disclosure.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF EXAMPLE EMBODIMENTS

Figure 1:
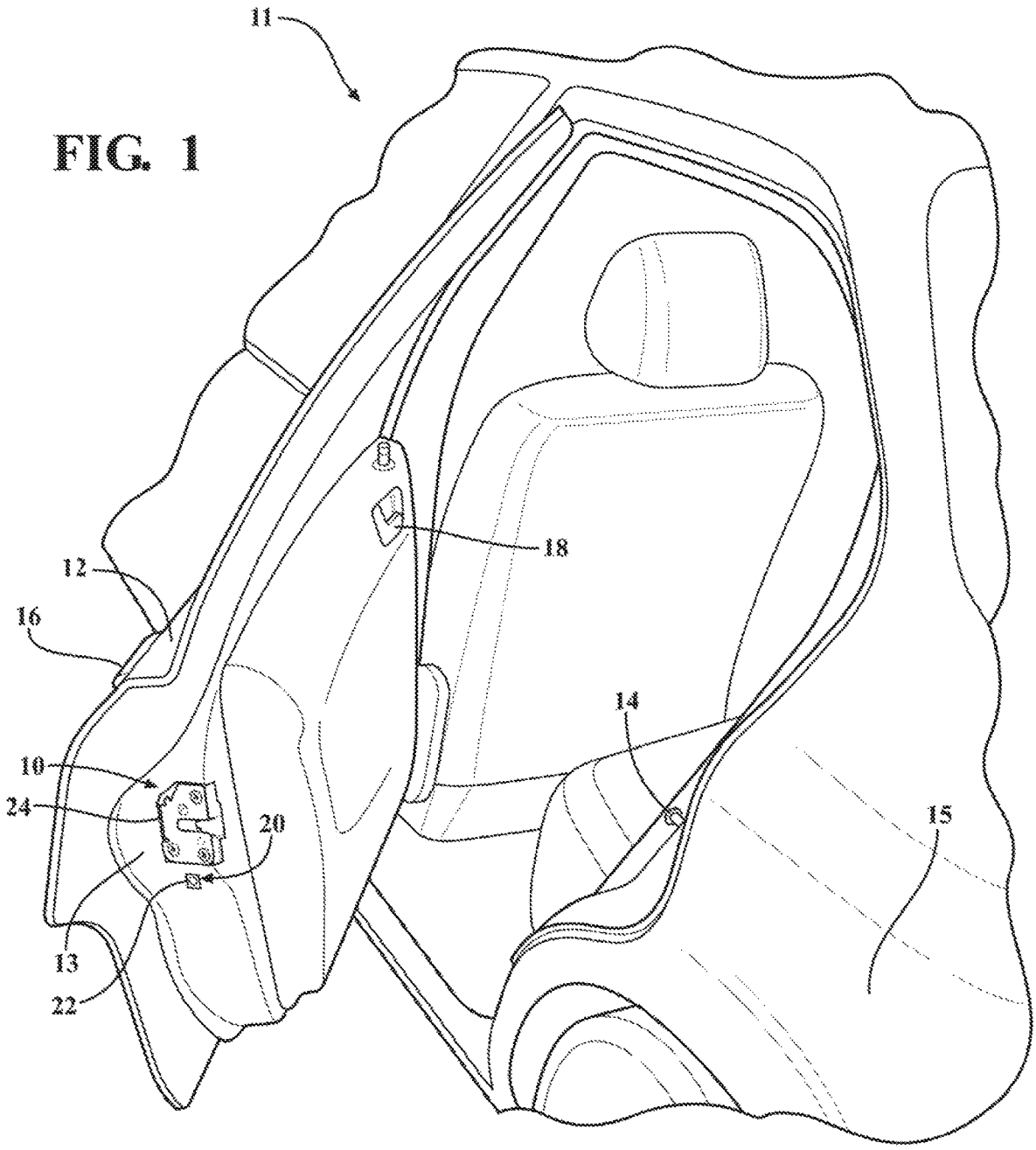
FIG. 1 is a perspective view of a passenger rear door region of a vehicle including a closure latch assembly in accordance with the disclosure.
Figure 2:
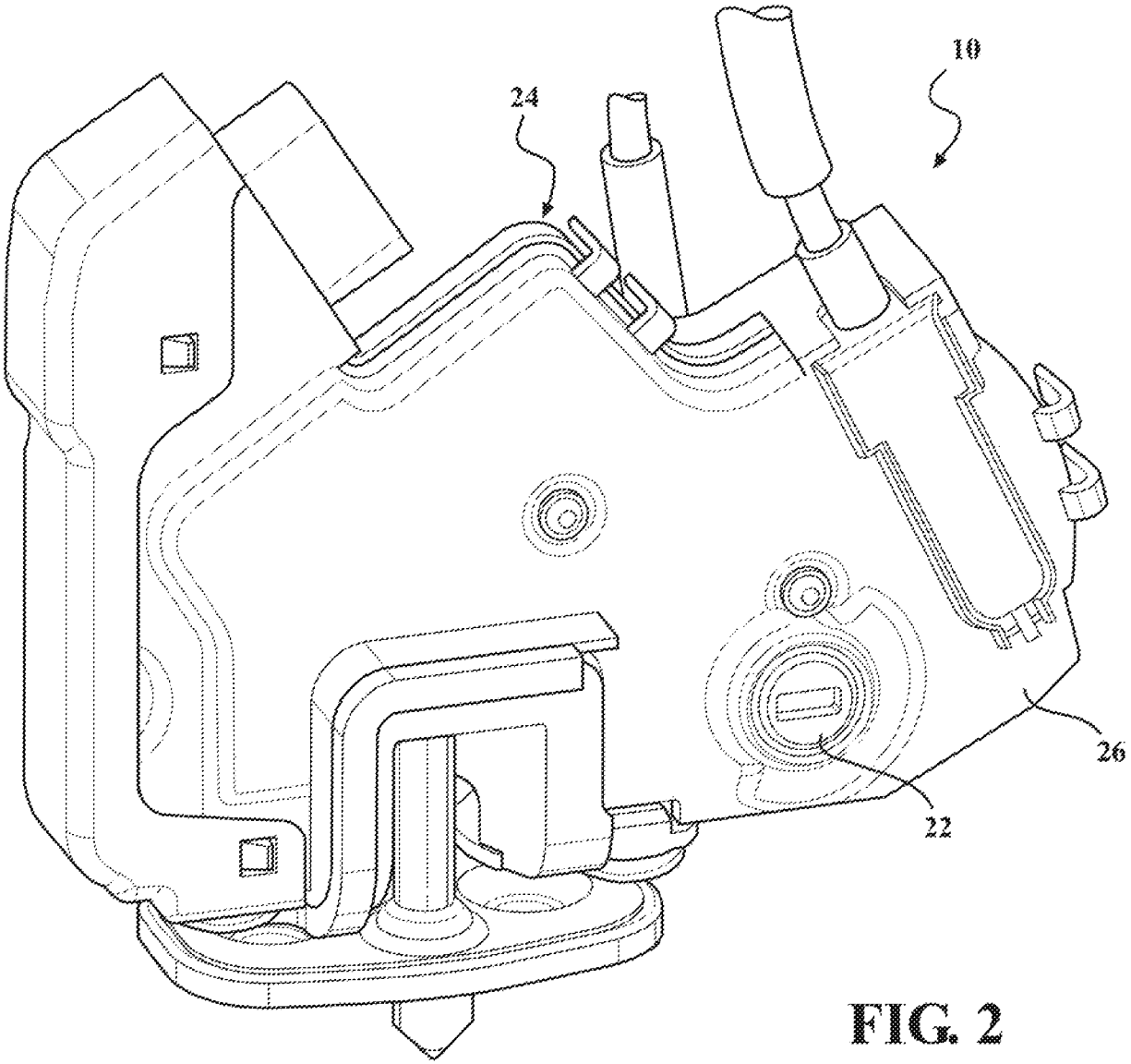
FIG. 2 is a perspective view of a child lock mechanism of the closure latch assembly in accordance with an aspect of the disclosure.
Figure 2A:
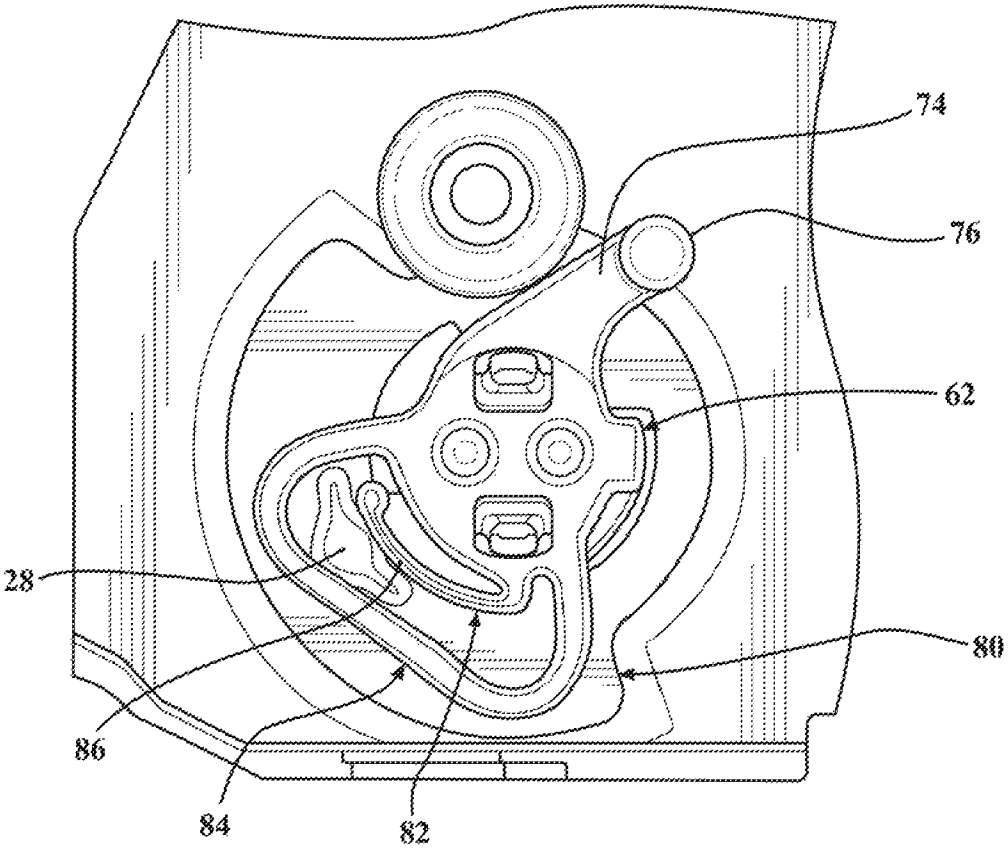
FIG. 2A is an internal view of a portion of the child lock mechanism of FIG. 2 showing a child lock lever in an unlocked position.

In general, example embodiments of closure latch assemblies and child lock mechanisms thereof constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Reference is made to FIG. 1 which shows an embodiment of a closure latch assembly 10 mounted to a passenger rear door 12 of a motor vehicle 11. The closure latch assembly 10 is positioned on a rear edge face 13 of the rear door 12 and is arranged in a suitable orientation to engage a striker 14 mounted on a vehicle body 15 of motor vehicle 11 when the rear door 12 is closed. Rear door 12 is shown to include an outside door handle 16, an inside door handle 18, and a child lock mechanism 20 operably associated closure latch assembly 10. The child latch mechanism 20, as detailed further below, requires a first force to move a child lock knob 22 to an on position and a second force to return the child lock knob 22 to an off position, wherein the second force required is greater than the first force. Accordingly, the spring force applied during actuation from the off position to the on position, and the spring force applied during actuation from the on position to the off position are asymmetrical. As such, a user receives tactile feedback indicating the relative position (on/off) the child lock mechanism 20 is in, thereby preventing unintended movement of the child lock mechanism 20 from one of the on/off positions to the other.

The closure latch assembly 10 includes a housing 24 having a wall 26 with a protrusion, also referred to as deflector, knob or detent 28 extending laterally outwardly therefrom. A ratchet 32 is mounted to the housing 24 for pivoting movement about pin 33 between a closed position (vehicle door 12 is closed) and an open position (vehicle door 12 can be opened). The ratchet 32 being biased toward the open position via a suitable biasing member, such as by a torsion or coil spring member, represented schematically by arrow 34 (FIGS. 3A-3B), by way of example and without limitation. A pawl 36 is mounted to the housing 24 for pivoting movement between a locking position, wherein the ratchet 32 is held in the primary closed position, and an unlocking position, wherein the ratchet 32 is free to move to the open position, wherein the pawl 36 is biased toward the locking position via a suitable biasing member, such as by a torsion or coil spring member, represented schematically by arrow 38 (FIGS. 3A-3B), by way of example and without limitation. At least one release member is operable communication with the pawl 36 to move the pawl 36 between the locking and unlocking positions. The at least one release member is shown in the non-limiting embodiment as a pawl lever 40 and a release lever 42. The pawl lever 40 is supported for pivotal movement about a common pin 44 with pawl 36, while release lever 42 is supported for pivotal movement about pin 46 (FIG. 3B). An inside release lever 48 is mounted to the housing 24 for pivoting movement about a pin 50 (FIG. 3A) between an actuated position and a released position, wherein the inside release lever 48 is biased toward the released position, such as by a torsion or coil spring member, represented schematically by arrow 52 (FIGS. 3A-3B), by way of example and without limitation. An auxiliary release lever 54 is configured for selective communication with the inside release lever 48 for pivoting movement between a first position and a second position about pin 50 in response to actuation of the inside release lever 48, while in communication with the inside release lever 48. The auxiliary release lever 54 is biased toward the first position, such as by a torsion or coil spring member, represented schematically by arrow 56 (FIGS. 3A-3B), by way of example and without limitation. A release link 58 is supported by the auxiliary release lever 54 for selective pivotal movement between a coupled position (FIG. 3A, 3B, 4A, 4B) with a laterally extending tab 60 of the inside release lever 48 and a decoupled position (FIG. 5A) out of engagement from the tab 60 of the inside release lever 48. The release link 58 is biased toward the coupled position, such as via being coupled to the auxiliary release lever 54, by way of example and without limitation. For example, spring 55 illustratively provides a bias force, represented schematically by arrow 57, in a clockwise direction as shown in FIG. 5B to bias release link 58 towards the coupled position.

Figure 3A:
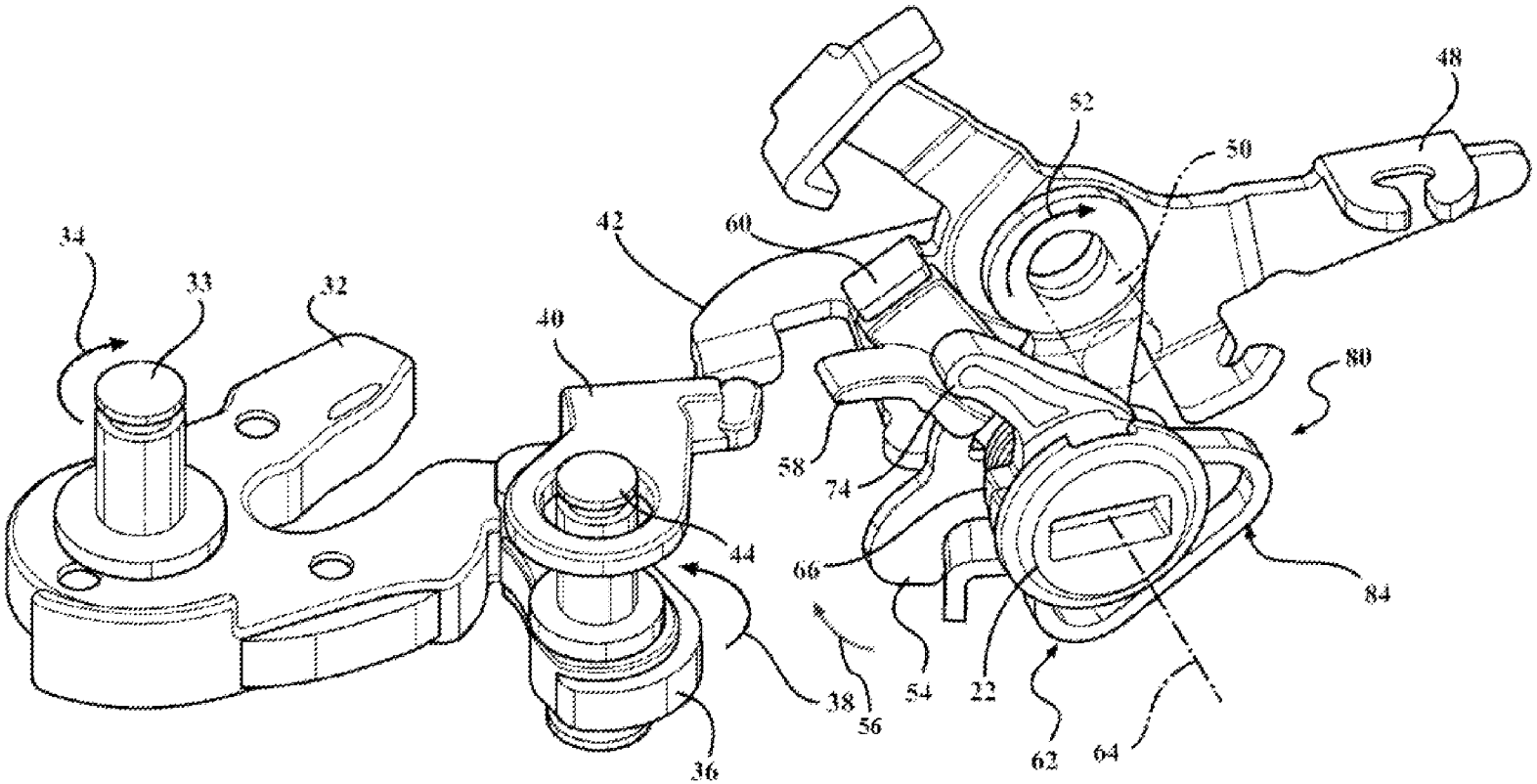
FIG. 3A is a perspective view of select components of the closure latch assembly of FIG. 1 with the child lock lever shown in the unlocked position.
Figure 3B:
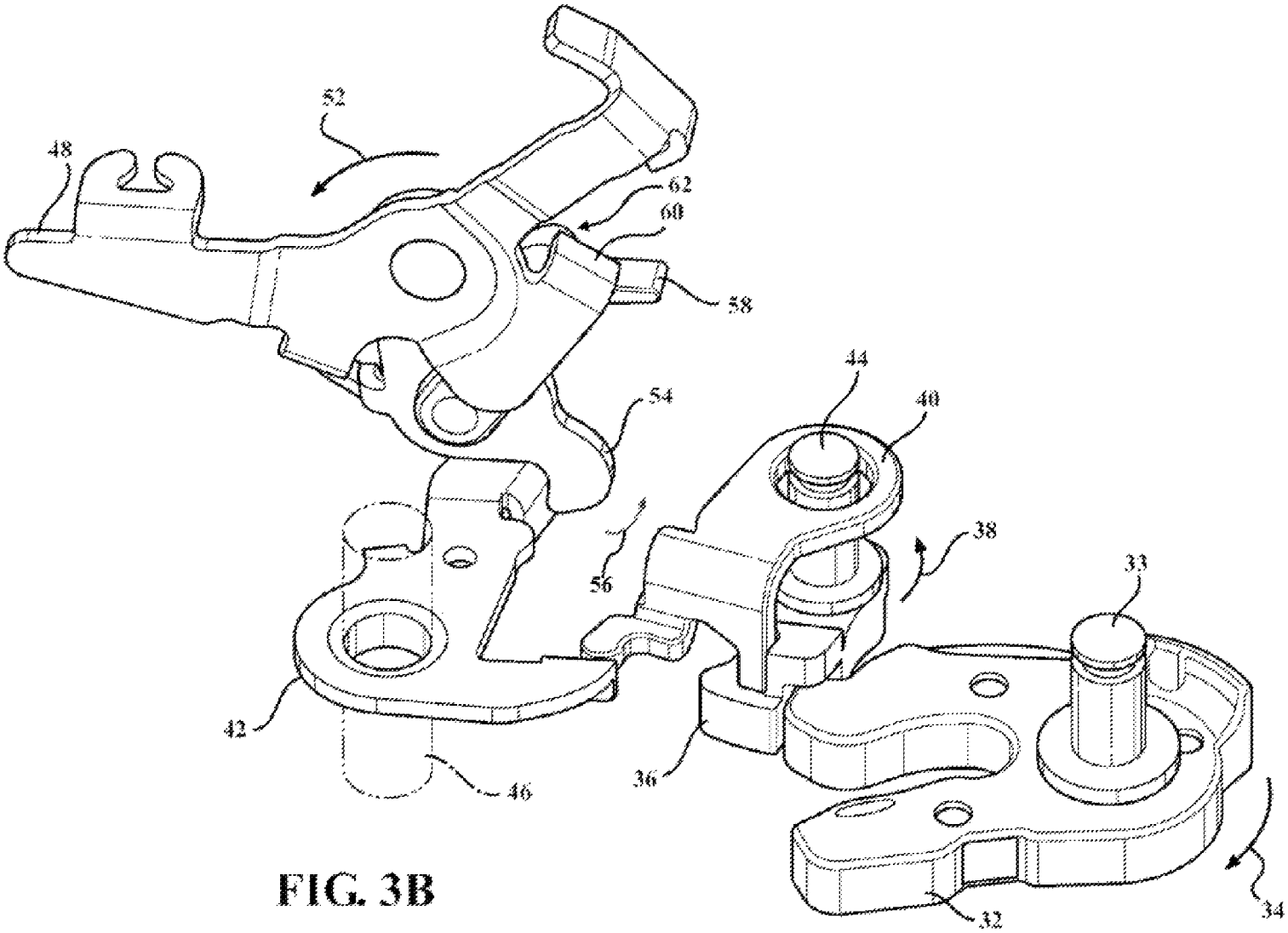
FIG. 3B is a view similar to FIG. 3A looking from an opposite side.
Figure 6:
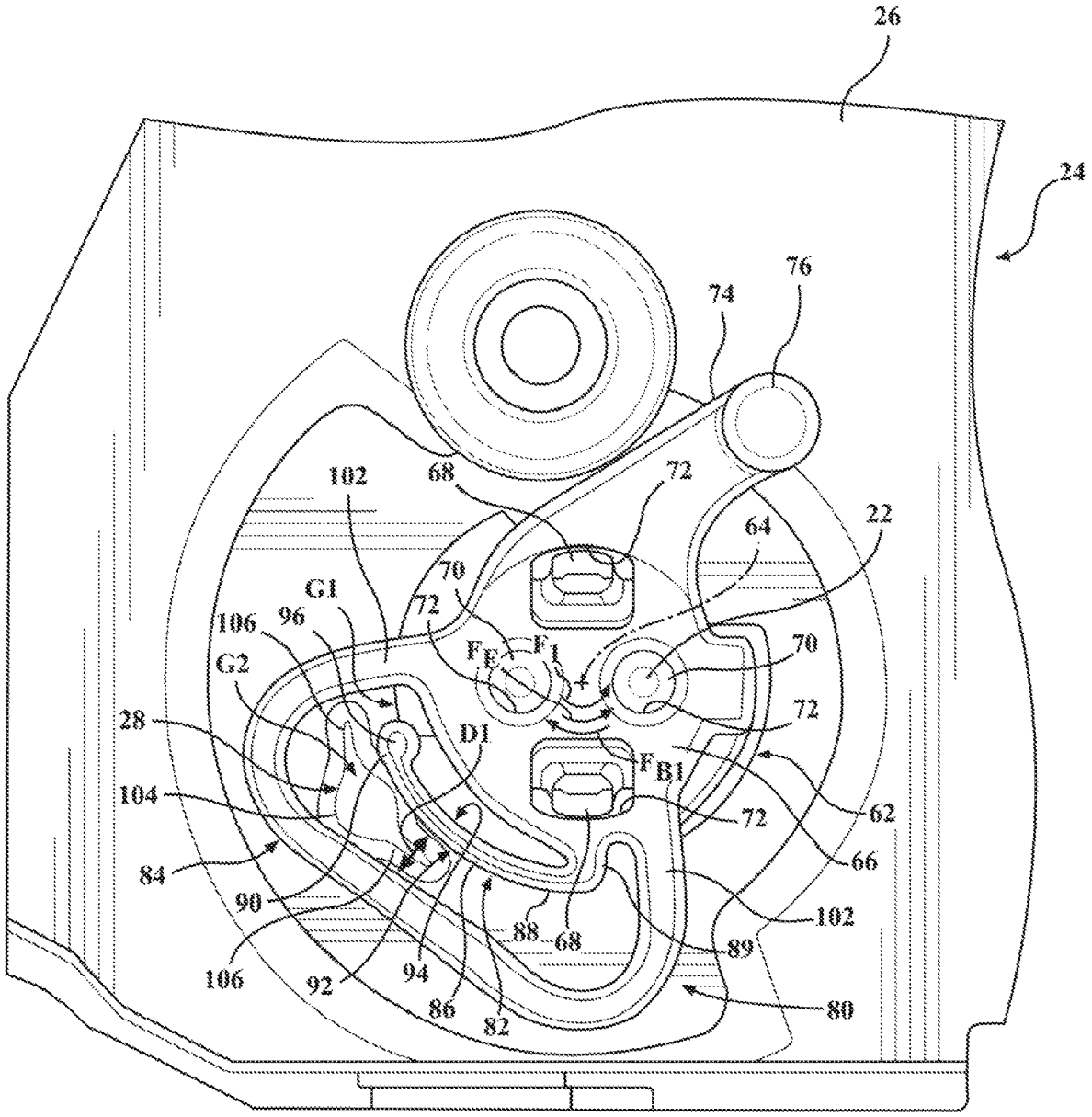
FIG. 6 is an enlarged view of the child lock lever shown in the unlocked position.
Figure 7:
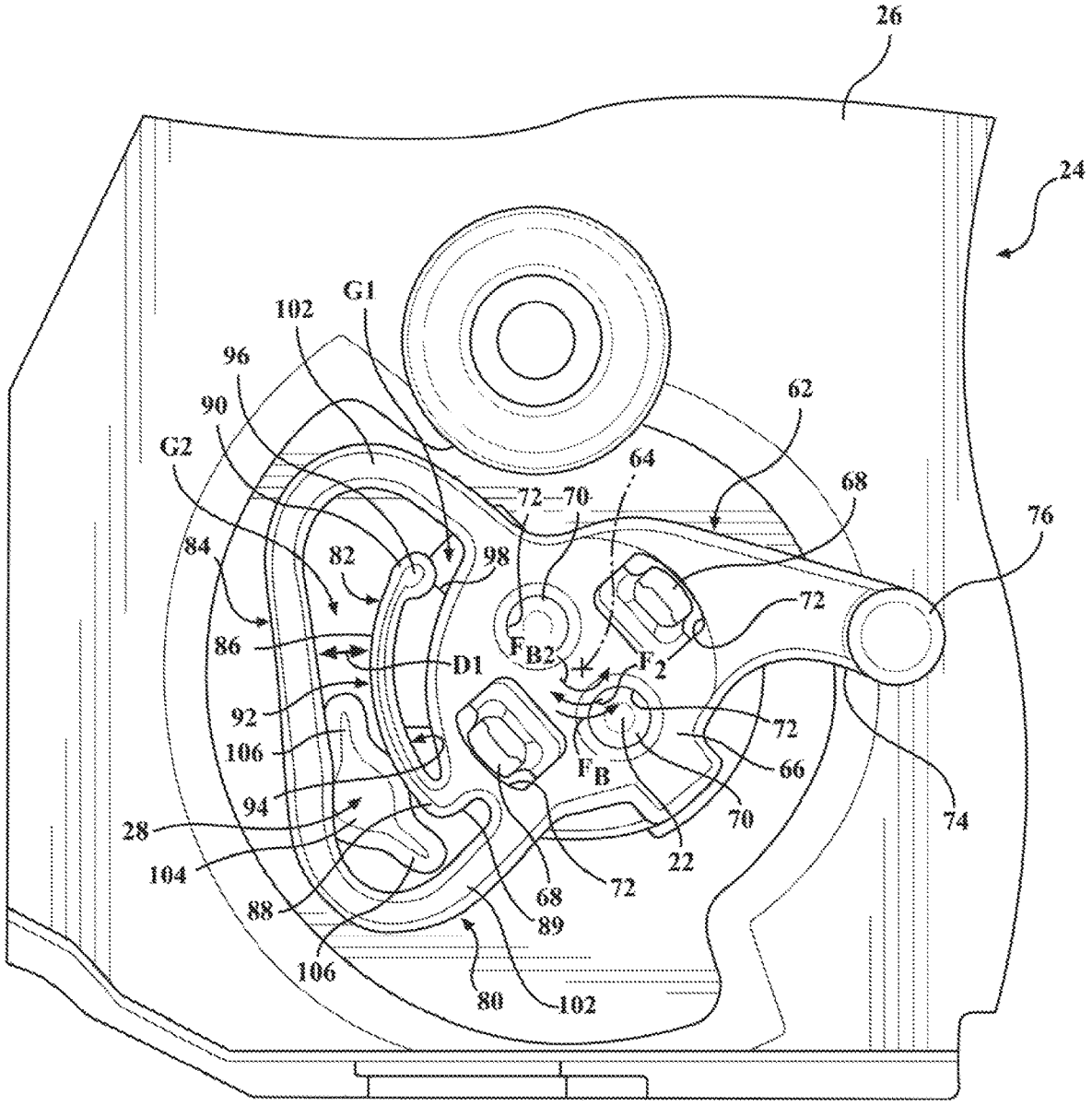
FIG. 7 is an enlarged view of the child lock lever shown in the locked position.

The closure latch assembly 10 includes the child lock mechanism 20 having the child lock knob 22 and a child lock lever 62 coupled for fixed rotation with one another about a child lock axis 64 (FIG. 3A). The child lock knob 22 is configured for selective rotation between an on position wherein the release link 58 is in the coupled position and an off position wherein the release link 58 is in the decoupled position. The child lock lever 62 is shown as being constructed of a single piece of material, such as molded plastic, by way of example and without limitation, thereby being economical in manufacture and assembly. The child lock lever 62 has a main, central body 66 fixed to the child lock knob 22, shown by way of example and without limitation as being via a snap fit via spring fingers 68 and location pins 70 of the child lock knob 22 mating with corresponding openings 72 in the child lock lever 62 (FIGS. 6 and 7). The child lock lever 62 includes a drive arm 74 extending radially outwardly, relative to the axis 64, from the body 66. The drive arm 74 is configured to pivot the release link 58, via operable connection thereto, between the coupled and decoupled positions in response to selective rotation of the child lock knob 22. An operable connection of the drive arm 74 to the release link 58 is shown, by way of example and without limitation, being provided via a pinned coupling, such a via a laterally extending pin 76 of the child lock lever 62 being disposed in a receptacle or opening 78 of the release link 58, such that selective rotation of the child lock lever 62 cause conjoint rotation of the release link 58 about axis 64. An asymmetrical spring system 80 extends radially outwardly from the body 66 in circumferentially spaced relation from the drive arm 74, shown as extending in diametrically opposite relation from the drive arm 74, by way of example and without limitation.

The spring system 80 includes an inside spring member 82 spaced radially outwardly (relative to axis 64) from the body 66 by a cavity or pocket formed by a first gap G1 (FIGS. 6 and 7) and an outside spring member 84 spaced radially outwardly from the inside spring member 82 by a cavity or pocket formed by a second gap G2 (FIGS. 6 and 7). While the child lock knob 22 is in the off position, the release link 58 is in the coupled position, bridging the auxiliary release lever 54 and the tab 60 of inside release lever 48, with a first spring force F1 of the inside spring member 82 being applied against the detent 28 while the child lock knob 22 is moved toward the on position. Meanwhile, while the child lock knob 22 is in the on position, the release link 58 is in the decoupled position, breaking the operable connection between the auxiliary release lever 54 and the tab 60 of the inside release lever 48, with a second spring force F2 of the inside spring member 82 being applied against the detent 28 while the child lock knob 22 is moved toward the off position, with the second spring force F2 being significantly and noticeably greater than the first spring force F1, such that a user can readily discern a tactile difference in movement of the child lock knob 22 from the off position to the on position (relatively easy and little resistance) versus movement of the child lock knob 22 from the on position to the off position (requiring noticeably increased effort with noticeably increased resistance). Accordingly, the user has tactile feedback indicating the position of the child lock knob 22 and lever 62 without having to reference visible indicators. In addition to the tactile feedback, with F2 being significantly greater than F1, the child lock mechanism 20 is assured of remaining the on position until desired otherwise, and for example F2 being provided to counter the bias force imparted by spring 55 to maintain the release link 58 in the uncoupled position when the child lock mechanism 20 is in the on position.

As best shown in FIGS. 6 and 7, the inside spring member 82 has an elongate arm 86 extending between a first end 88 fixed to the body 66 via a leg 89 and an opposite free second end 90 cantilevered in spaced relation from the body 66. The arm 86 extends along a smooth arcuate path from the first end 88 to the second end 90 along a constant or substantially constant radius, with a convex outer surface 92 facing the outside spring member 84 and a concave inner surface 94 facing the body 66. The free second end 90 is shown having a bulbous, rounded terminus 96. With inside spring member 82 being cantilevered, a spring force of inside spring member 82 increases as a radially applied force thereon gets closer to leg 89, given the lever arm of the arm 86 of inside spring member 82 decreases as the applied force gets closer to leg 89.

The outside spring member 84 has a straight or substantially straight portion, also referred to as bridge 100, directly overlying the inside spring member 82 in radially outwardly spaced, radially aligned relation therewith. The bridge 100 extends to opposite end regions 102 that are fixed to the body 66. The opposite end regions 102 extend from the bridge 100 radially inwardly to the body 66. The opposite end regions 102 are shown in a non-limiting embodiment as converging from the bridge 100 inwardly generally toward the child lock axis 64. As such, the inside spring member 82 is circumferentially bounded by the outside spring member 84 and the body 66.

The detent 28 is shown as being generally oblong, having a bulbous central portion 104 with opposite legs 106 tapering down away therefrom. With the inside spring member 82 being arcuate and the outside spring member being straight, as discussed above, the gap G2 has a reduced, minimum radially extending distance D1 located at an approximate center of the bridge 100, with the gap G2 increasing in radially extending distance along opposite circumferential directions from the geometric center of bridge 100, as viewed in FIGS. 6 and 7. The size (e.g. diameter) of central portion 104 of detent 28 is greater than D1, thereby causing bridge 100 to expand and flex (bow) radially outwardly as the detent 28 passes along bridge 100 during movement between the on/off positions.

As viewed in FIGS. 6 and 7, when the child lock mechanism 20 is in the off position, the central portion 104 of detent 28 is immediately adjacent the second end 90 and terminus 96 of inside spring member 82. Meanwhile, when the child lock mechanism 20 is in the on position, the central portion 104 of detent 28 is immediately adjacent the first end 88 and leg 89 of inside spring member 82.

Figure 4A:
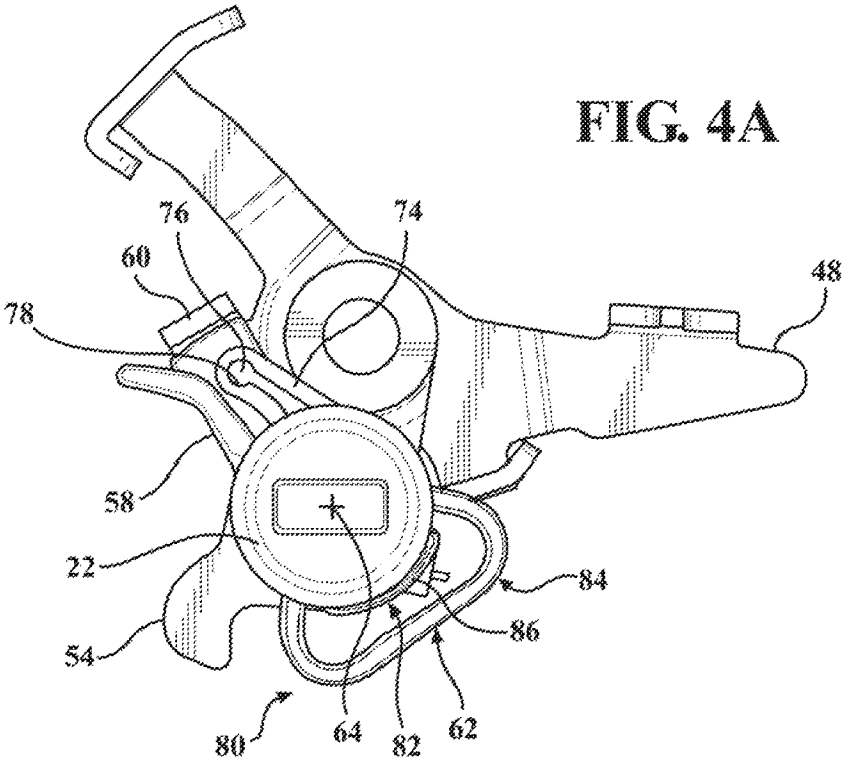
FIG. 4A is a side view of the child lock assembly of FIG. 2 with a cover removed with the child lock lever shown in the unlocked position.
Figure 5A:
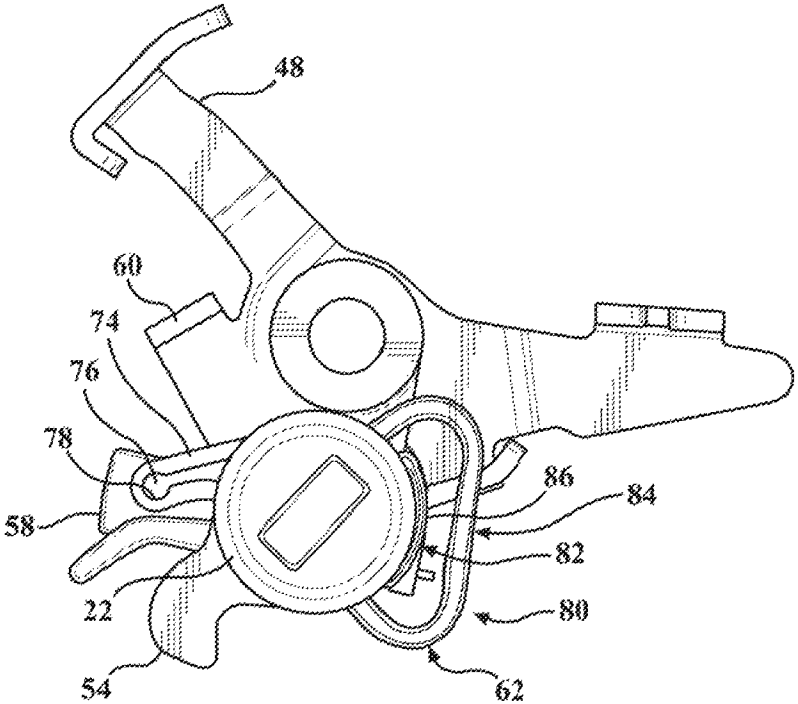
FIGS. 5A and 5B are views similar to FIGS. 4A and 4B with the child lock lever shown in a locked position.
Figure 4B:
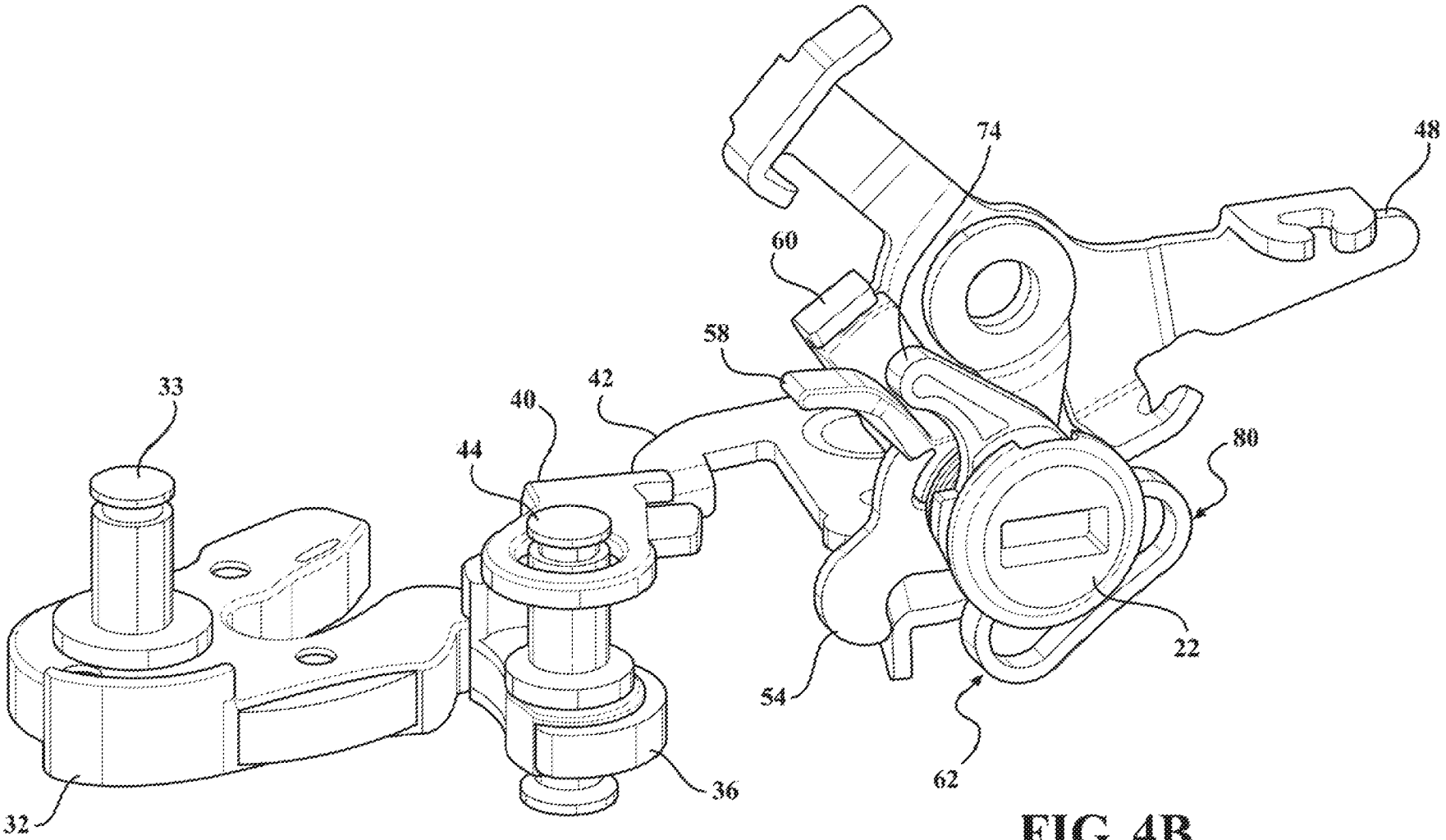
FIG. 4B is a perspective view of the child lock lever as shown in FIG. 4A with an inside release lever being actuated to release a pawl from a ratchet of the closure latch assembly.
Figure 5B:
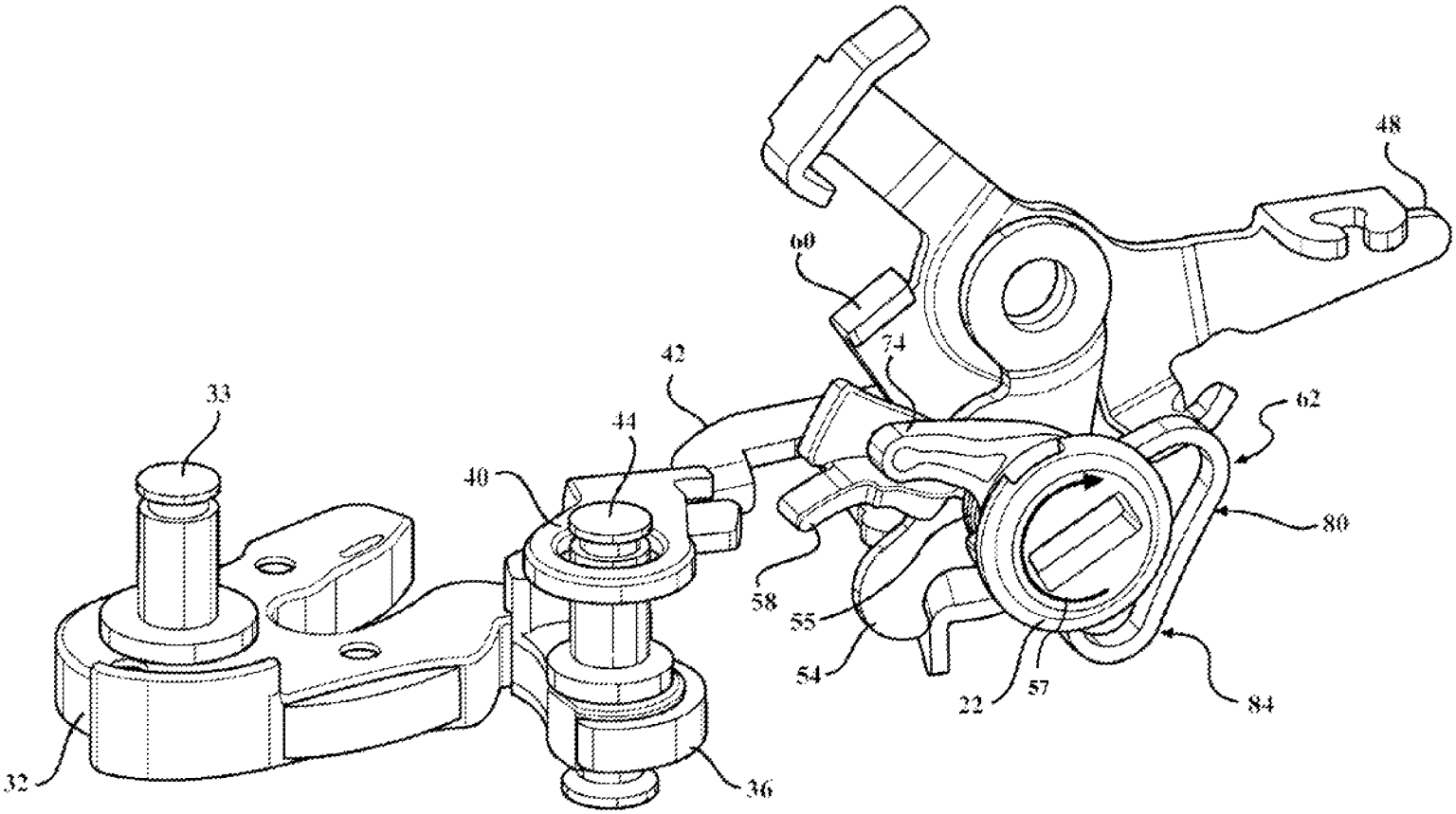

In use, with the child lock mechanism 20 in the off position (FIG. 6), a user need simply actuate the child lock knob 22 via rotation thereof in a first direction (counterclockwise as viewed in FIG. 4A). As the child lock knob 22 is being rotated from the off position toward the on position, the detent 28 traverses along the outer surface 92 of the inside spring member 82, the elongate arm 86 is able to flex freely radially inwardly, thereby imparting a relatively light spring load against the detent 28 in combination with the outside spring member 84 resisting rotation, represented by vector $F_1$. At the same time, the outside spring member 84 imparts a minimal force on detent 28 by not having to flex greatly in a radially outward direction. Bias 55 also imparts a minimal force represented by vector $F_{B1}$. A user rotating lock knob 22 from the initial unlocked position to the locked position will require to exert a sum of the forces $F_1$ and $F_{B1}$ also referred to as an engagement force $F_E$ to initially move the lock knob 22, and since inside spring member 82 imparting a relatively light spring load, inside spring member 82 initially does not increase engagement force $F_E$. This allows the child lock mechanism 20 to be actuated to the on position under a relatively reduced amount of resistance. As the detent 28 traverses the reduced distance D1 in the center of bridge 100 and the center of arm 86, the applied resistance is maximized, and then upon passing beyond the associated centers, the applied resistance diminishes, thereby acting as an over-center toggle-like mechanism. When in the on position, the release link 58 is pivoted out of engagement with tab 60 of inside release lever 48, thereby rendering the inside door handle 18 temporarily inoperable.

Then, upon desiring to render inside door handle 18 operable, the child lock mechanism 20 can be actuated via the user rotating the child lock knob 22 in a second direction (clockwise as viewed in FIG. 5A) opposite the first direction. As the child lock knob 22 is being rotated from the on position toward the off position, the detent 28 traverses along the outer surface 92 of the inside spring member 82 and the elongate arm 86 is initially inhibited from flexing freely radially inwardly due to a minimal lever arm extending from the leg 89, thereby imparting a relatively high spring load against the detent 28 in combination with the outside spring member 84. As will be understood, with the inside spring member 82 being initially prevented from flexing inwardly due to the proximity of the leg 89 with the detent 28, the outside spring member 84 must flex radially outwardly to a greater extent initially than flexed while moving the detent toward the on position. Accordingly, the user experiences an increased spring load and increased resistance to actuation of the child lock mechanism 20 while moving, in toggle-like fashion, the child lock knob 22 toward the off position relative to the spring load and resistance experienced while moving the child lock knob 22, in toggle-like fashion, toward the on position. As such, the user receives immediate, readily perceivable tactile feedback indicating that the child lock mechanism 20 is being moved toward the off position. Accordingly, due to the asymmetrical spring loads experienced during actuation of the off position to the on position, and vice versa, aside from being alerted to the direction of actuation, the child lock mechanism 20 is assuredly maintained in the on position, as intended, until it is desired to move the child lock mechanism to the off position. When the child lock mechanism 20 is maintained in the on position, loaded bias 55 also imparts a maximal force $F_{B2}$ which is resisted by the inside spring member 82 and outside spring member 84 providing a locking or holding force resisting rotation of child lock knob 22 towards the off position as described herein above, represented by vector $F_2$. A user rotating lock knob 22 towards the off position will require to exert a force greater than a difference of the forces $F_2$ and $F_{B2}$ also referred to as a disengagement force $F_D$ to initially move the lock knob 22 towards the off position. Engagement force $F_E$ and a disengagement force $F_D$ may therefore be equalized or balanced, in other words, the forces required to move the child lock knob 22 as experienced by a user will more closely match when moving the child lock mechanism 20 from the off position to the on position, or from the on position to the off position by decreasing the initial engagement force $F_E$ as a result of inside spring member 82 initially imparting the relatively light spring load when the lock knob 22 is in the off position, and increasing the initial disengagement force $F_D$ as a result of inside spring member 82 imparting the relatively high spring load against the detent 28 when the lock knob 22 is in the on position, as an illustrative example.

Figure 8:
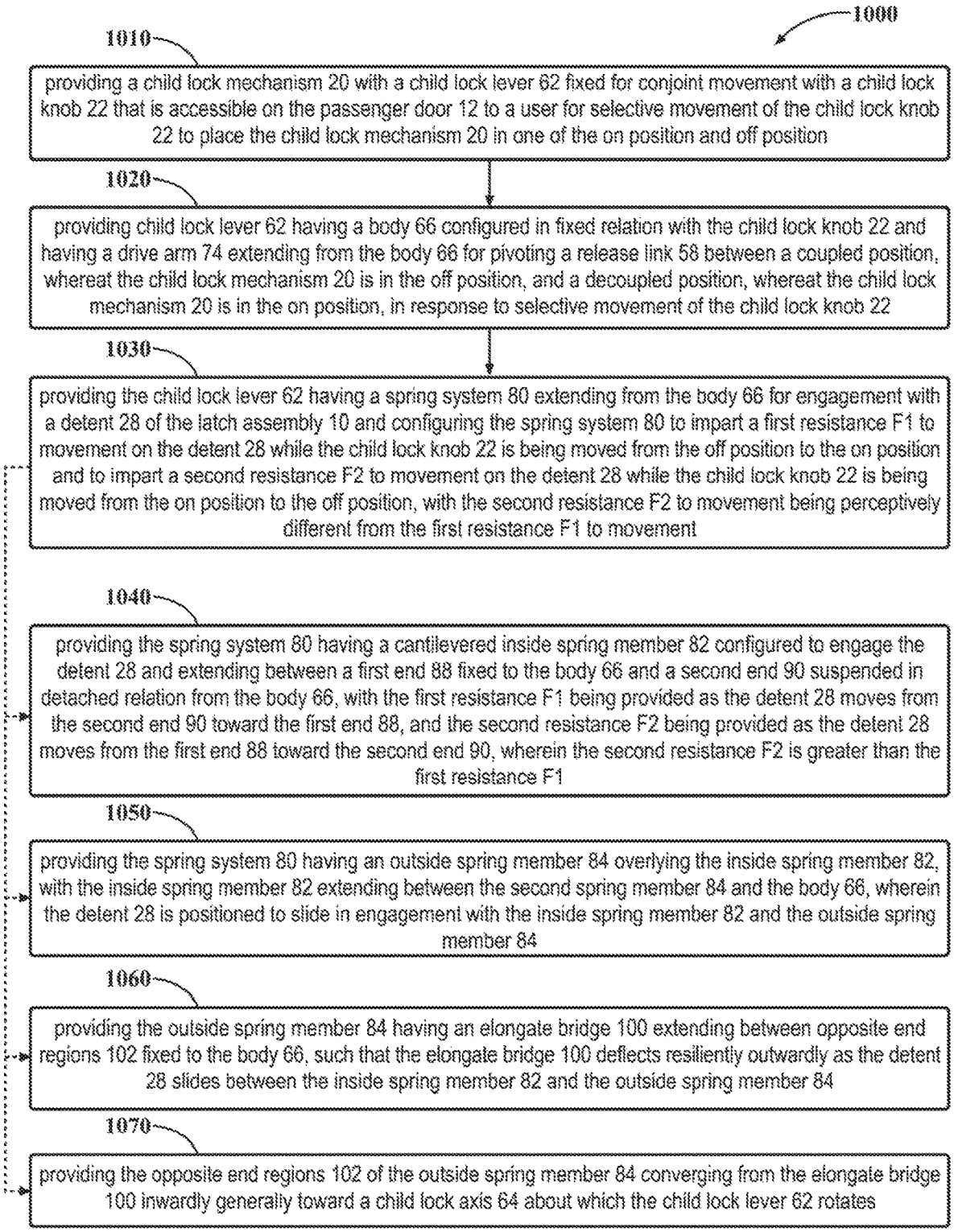
FIG. 8 is a flow diagram illustrating a method of providing tactile feedback to a user to indicate whether a lock knob of a motor vehicle closure latch assembly is being actuated to an on or off position.

In accordance with another aspect of the disclosure, as diagrammatically illustrated in FIG. 8, a method 1000 of indicating, via tactile feedback, to a user that a child lock mechanism 20 of a latch assembly 10 for a passenger door 12 of a motor vehicle 11 is being moved toward an on position, whereat the passenger door 12 is unable to be opened by via actuation of an inside door handle 18, and an off position, whereat the passenger door 12 is able to be opened by via actuation of an inside door handle 18, is provided. The method 1000 includes a step 1010 of providing the child lock mechanism 20 with a child lock lever 62 fixed for conjoint movement with a child lock knob 22 that is accessible on the passenger door 12 to a user for selective movement of the child lock knob 22 to place the child lock mechanism 20 in one of the on position and off position. The method further includes a step 1020 of providing child lock lever 62 having a body 66 configured in fixed relation with the child lock knob 22 and having a drive arm 74 extending from the body 66 for pivoting a release link 58 between a coupled position, whereat the child lock mechanism 20 is in the off position, and a decoupled position, whereat the child lock mechanism 20 is in the on position, in response to selective movement of the child lock knob 22. The method further includes a step 1030 of providing the child lock lever 62 having a spring system 80 extending from the body 66 for engagement with a detent 28 of the latch assembly 10 and configuring the spring system 80 to impart a first resistance F1 to movement on the detent 28 while the child lock knob 22 is being moved from the off position to the on position and to impart a second resistance F2 to movement on the detent 28 while the child lock knob 22 is being moved from the on position to the off position, with the second resistance F2 to movement being perceivably (via tactile feel of the user, such as via noticeable torque difference) different from the first resistance F1 to movement.

The method 1000 can further include a step 1040 of providing the spring system 80 having a cantilevered inside spring member 82 configured to engage the detent 28 and extending between a first end 88 fixed to the body 66 and a second end 90 suspended in detached relation from the body 66, with the first resistance F1 being provided as the detent 28 moves from the second end 90 toward the first end 88, and the second resistance F2 being provided as the detent 28 moves from the first end 88 toward the second end 90, wherein the second resistance F2 is greater than the first resistance F1.

The method 1000 can further include a step 1050 of providing the spring system 80 having an outside spring member 84 overlying the inside spring member 82, with the inside spring member 82 extending between the second spring member 84 and the body 66, wherein the detent 28 is positioned to slide in engagement with the inside spring member 82 and the outside spring member 84.

The method 1000 can further include a step 1060 of providing the outside spring member 84 having an elongate bridge 100 extending between opposite end regions 102 fixed to the body 66, such that the elongate bridge 100 deflects resiliently outwardly as the detent 28 slides between the inside spring member 82 and the outside spring member 84.

The method 1000 can further include a step 1070 of providing the opposite end regions 102 of the outside spring member 84 converging from the elongate bridge 100 inwardly generally toward a child lock axis 64 about which the child lock lever 62 rotates.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a passenger door of a motor vehicle, comprising:

a housing;

a detent fixed in said housing;

a ratchet mounted to said housing for pivoting movement between a closed position and an open position;

a pawl mounted to said housing for pivoting movement between a locking position, whereat said ratchet is held in said closed position, and an unlocking position, whereat said ratchet is allowed to move to said open position;

an inside release lever mounted to said housing for pivoting movement between an actuated position and a released position;

an auxiliary release lever configured in operable communication with said pawl and in selective communication with said inside release lever for pivoting movement between a first position and a second position in response to actuation of said inside release lever to move said pawl from the locking position to the unlocking position while in communication with said inside release lever;

a release link supported by said auxiliary release lever for selective pivotal movement between a coupled position with said inside release lever, whereat said inside release lever is in selective communication with said auxiliary release lever to allow movement of said pawl from the locking position to the unlocking position upon pivoting said inside release lever to the actuated position, and a decoupled position from said inside release lever, whereat said inside release lever is not in selective communication with said pawl to prevent movement of said pawl from the locking position to the unlocking position upon pivoting said inside release lever to the actuated position; and a child lock mechanism including a child lock knob and a child lock lever coupled for fixed rotation with one another about a child lock axis, said child lock knob being configured for selective rotation between an on position whereat said release link is in the decoupled position and an off position whereat said release link is in the coupled position, said child lock lever having a body fixed to said child lock knob with a drive arm extending from said body to pivot said release link between the coupled position and decoupled position in response to selective rotation of said child lock knob, a spring system extending from said body, said spring system including an inside spring member spaced outwardly from said body by a first gap and an outside spring member spaced outwardly from said inside spring member by a second gap such that said inside spring member is between said outside spring member and said body, wherein while said child lock knob is in the off position, a first spring force of said inside spring member against said detent is encountered while said child lock knob is moved toward the on position, and wherein while said child lock knob is in the on position, a second spring force of said inside spring member against said detent is encountered while said child lock knob is moved toward the off position, said second spring force being greater than said first spring force.

2. The latch assembly of claim 1, wherein said inside spring member has an elongate arm extending between a first end fixed to said body and an opposite second end cantilevered in spaced relation from said body.

3. The latch assembly of claim 2, wherein said detent is located adjacent said second end of said inside spring member while said child lock knob is in the off position, and said detent is located adjacent said first end of said inside spring member while said child lock knob is in the on position.

4. The latch assembly of claim 2, wherein said elongate arm of said inside spring member is arcuate.

5. The latch assembly of claim 4, wherein said elongate arm of said inside spring member has a convex surface facing said outside spring member.

6. The latch assembly of claim 4, wherein said outside spring member has a substantially straight portion overlying said inside spring member.

7. The latch assembly of claim 2, wherein said outside spring member has an elongate bridge extending between opposite end regions fixed to said body.

8. The latch assembly of claim 7, wherein said elongate bridge has a substantially straight portion extending between said opposite end regions, said substantially straight portion being spaced outwardly in overlying relation with said inside spring member.

9. The latch assembly of claim 8, wherein said opposite end regions extend from said substantially straight portion inwardly to said body.

10. The latch assembly of claim 9, wherein said opposite end regions converge from said substantially straight portion inwardly generally toward said child lock axis.

11. The latch assembly of claim 1, further including at least one release member operably communicating the auxiliary release lever with the pawl.

12. The latch assembly of claim 11, wherein said at least one release member includes a pawl lever and a release lever configured in operable communication with one another.

13. A child lock mechanism of a latch assembly for a passenger door of a motor vehicle for selectively moving a release link of the latch between a coupled position, whereat an inside door handle is operable to open the passenger door, and a decoupled position, whereat the inside door handle is inoperable to open the passenger door, comprising:

a child lock knob and a child lock lever coupled for fixed rotation with one another about a child lock axis, said child lock knob being configured for selective rotation between an on position whereat the release link is in the decoupled position and an off position whereat the release link is in the coupled position, said child lock lever having a body fixed to said child lock knob with a drive arm extending from said body to pivot the release link between the coupled position and decoupled position in response to selective rotation of said child lock knob, a spring system extending from said body, said spring system including an inside spring member spaced outwardly from said body by a first gap and an outside spring member spaced outwardly from said inside spring member by a second gap such that said inside spring member is between said outside spring member and said body, wherein while said child lock knob is in the off position, a first spring force of said inside spring member must be overcome to move said child lock knob to the on position, and wherein while said child lock knob is in the on position, a second spring force of said inside spring member must be overcome to move said child lock knob to the off position, said second spring force being greater than said first spring force.

14. The child lock mechanism of claim 13, wherein said inside spring member has an elongate arm extending between a first end fixed to said body and an opposite second end cantilevered in spaced relation from said body.

15. The child lock mechanism of claim 14, wherein said outside spring member has an elongate bridge extending between opposite end regions fixed to said body.

16. A method of indicating to a user that a child lock mechanism of a latch assembly for a passenger door of a motor vehicle is being moved toward an on position, whereat the passenger door is unable to be opened by via actuation of an inside door handle, and an off position, whereat the passenger door is able to be opened by via actuation of the inside door handle, comprising:

providing the child lock mechanism with a child lock lever fixed for conjoint movement with a child lock knob that is accessible on the passenger door to a user for selective movement of the child lock knob to place the child lock mechanism in one of the on position and off position;

providing child lock lever having a body configured to be fixed to the child lock knob and having a drive arm extending from the body for pivoting a release link between a coupled position, whereat the child lock mechanism is in the off position, and a decoupled position, whereat the child lock mechanism is in the on position, in response to selective movement of the child lock knob; and providing the child lock lever having a spring system extending from the body for engagement with a detent of the latch assembly and configuring the spring system to impart a first resistance to movement on the detent while the child lock knob is being moved from the off position to the on position and to impart a second resistance to movement on the detent while the child lock knob is being moved from the on position to the off position, with the second resistance to movement being different from the first resistance to movement.

17. The method of claim 16, further including providing the spring system having a cantilevered inside spring member configured to engage the detent and extending between a first end fixed to the body and a second end suspended in detached relation from the body, with the first resistance being provided as the detent moves from the second end toward the first end, and the second resistance being provided as the detent moves from the first end toward the second end, wherein the second resistance is greater than the first resistance.

18. The method of claim 17, further including providing the spring system having an outside spring member overlying the inside spring member, with the inside spring member extending between the second spring member and the body, wherein the detent is positioned to slide in engagement with the inside spring member and the outside spring member.

19. The method of claim 18, further including providing the outside spring member having an elongate bridge extending between opposite end regions fixed to the body, such that the elongate bridge deflects resiliently outwardly as the detent slides between the inside spring member and the outside spring member.

20. The method of claim 18, further including providing the opposite end regions of the outside spring member converging from the elongate bridge inwardly generally toward a child lock axis about which the child lock lever rotates.

* * * * *